US008720099B1

(12) United States Patent
Sisk

(10) Patent No.: US 8,720,099 B1
(45) Date of Patent: May 13, 2014

(54) MULTI-AXIS ADJUSTABLE BUTTSTOCK

(71) Applicant: Charles H. Sisk, Dayton, TX (US)

(72) Inventor: Charles H. Sisk, Dayton, TX (US)

( * ) Notice: Subject to any disclaimer, the term of this patent is extended or adjusted under 35 U.S.C. 154(b) by 0 days.

(21) Appl. No.: 13/986,479

(22) Filed: May 7, 2013

(51) Int. Cl.
*F41C 23/00* (2006.01)
*F41C 23/20* (2006.01)
*F41C 23/14* (2006.01)

(52) U.S. Cl.
CPC ..... *F41C 23/00* (2013.01); *F41C 23/20* (2013.01); *F41C 23/14* (2013.01)
USPC ..... 42/73

(58) Field of Classification Search
CPC ..... F41C 23/04; F41C 23/14; F41C 23/20; F41C 23/22; F41C 23/12; F41C 23/06; F41C 23/08; F41C 23/10; F41C 23/00; F41C 27/00; F41C 33/006; F41C 33/0218; F41C 33/046; F41C 7/02
USPC ..... 42/72, 73, 74
See application file for complete search history.

(56) References Cited

U.S. PATENT DOCUMENTS

| | | | | | |
|---|---|---|---|---|---|
| 1,430,661 | A | * | 10/1922 | Lewis | 89/193 |
| 1,457,961 | A | * | 6/1923 | Browning | 89/145 |
| 1,533,966 | A | * | 4/1925 | Browning | 89/138 |
| 2,090,340 | A | * | 8/1937 | Browning | 89/139 |
| 2,121,982 | A | * | 6/1938 | Pugsley | 206/305 |
| 2,400,349 | A | * | 5/1946 | Haberstump | 42/72 |
| 3,707,797 | A | * | 1/1973 | Ruth | 42/74 |
| 4,203,244 | A | | 5/1980 | Hickman | |
| 4,663,877 | A | * | 5/1987 | Bragg | 42/74 |
| 4,769,937 | A | | 9/1988 | Gregory et al. | |
| 4,896,446 | A | * | 1/1990 | Gregory | 42/73 |
| 5,001,855 | A | * | 3/1991 | Griggs | 42/74 |
| 5,031,348 | A | | 7/1991 | Carey | |
| 5,075,995 | A | | 12/1991 | Kennel | |
| 5,367,812 | A | * | 11/1994 | Lautrec | 42/74 |
| 5,711,102 | A | * | 1/1998 | Plaster et al. | 42/71.01 |
| 5,752,339 | A | * | 5/1998 | Bentley et al. | 42/74 |
| 6,467,212 | B1 | | 10/2002 | Apel | |
| 6,684,549 | B2 | * | 2/2004 | Bragg | 42/74 |
| 7,152,355 | B2 | | 12/2006 | Fitzpatrick et al. | |
| 7,536,819 | B2 | | 5/2009 | Popikow | |
| 7,647,719 | B2 | | 1/2010 | Fitzpatrick et al. | |
| 7,762,018 | B1 | | 7/2010 | Fitzpatrick et al. | |
| 7,930,849 | B2 | * | 4/2011 | Abraham et al. | 42/73 |
| 2003/0221352 | A1 | * | 12/2003 | Steele | 42/73 |
| 2006/0254112 | A1 | * | 11/2006 | Snoderly | 42/74 |
| 2007/0089347 | A1 | * | 4/2007 | Webber et al. | 42/75.03 |
| 2008/0028662 | A1 | * | 2/2008 | Abraham et al. | 42/73 |
| 2010/0132240 | A1 | * | 6/2010 | Webber et al. | 42/75.03 |

* cited by examiner

*Primary Examiner* — Samir Abdosh
(74) *Attorney, Agent, or Firm* — Gordon K Anderson

(57) ABSTRACT

A multi-axis adjustable buttstock is taught that incorporates a buttstock, having, a grip neck, and a butt along with an interfaced set of two serrated grip retainers attached onto the buttstock grip neck, for buttstock tilt adjustment. A plurality of selectable flat and tapered grip spacers engage the grip serrated retainers for trigger grip length, cast and drop adjustment of the buttstock. A flanged stock bolt is disposed through a portion of the buttstock retaining the spacers and grip retainers while being embraced tightly by a first lock ring. A threaded rod is inserted into the buttstock a desired distance for length of pull adjustment and a second threaded lock ring is positioned on the threaded rod for securement. A recoil pad adapter plate, having a plurality of concentric holes, is attached to the threaded rod, for recoil pad slant adjustment, and a recoil pad is attached to the adapter plate aligned with selected recoil pad holes for recoil pad height and angle adjustments.

19 Claims, 7 Drawing Sheets

MULTI-AXIS ADJUSTABLE BUTTSTOCK

CROSS REFERENCE TO RELATED APPLICATION

This application claims priority of Provisional Patent Application Ser. No. 61/743,160 filed Aug. 28, 2012.

TECHNICAL FIELD

The present invention relates to gunstocks in general. More specifically to a buttstock that incorporates a wide variety of adjustments to obtain a perfect fit either by the manufacturer, or by the owner in the field using adjustments integral with the buttstock itself.

BACKGROUND OF THE INVENTION

Previously, many types of adjustable features in a firearm butt stock have been used in endeavoring to provide an effective means to compensate for the variation in the physical requirements of the shooter.

The prior art listed below did not disclose patents that possess any of the novelty of the instant invention; however the following U.S. patents are considered related:

| U.S. Pat. No. | Inventor | Issue Date |
|---|---|---|
| 4,203,244 | Hickman | May 20, 1980 |
| 4,769,937 | Gregory et al. | Sep. 13, 1988 |
| 4,896,446 | Gregory | Jan. 30, 1990 |
| 5,031,348 | Carey | Jul. 16, 1991 |
| 5,075,995 | Kennel | Dec. 31, 1991 |
| 5,711,102 | Plaster et al. | Jan. 27, 1998 |
| 6,467,212 B2 | Apel | Oct. 22, 2002 |
| 7,152,355 B2 | Fitzpatrick et al. | Dec. 26, 2006 |
| 7,536,819 B2 | Popikow | May 26, 2009 |
| 7,647,719 B2 | Fitzpatrick et al. | Jan. 19, 2010 |
| 7,762,018 B1 | Fitzpatrick et al. | Jul. 27, 2010 |

Hickman in U.S. Pat. No. 4,203,244 teaches an attachment to elevate a shooter's line of sight above the barrel. The attachment includes a recoil absorbing pad and a stock elevator rounded to fit a shooter's cheek with a set screw for elevating the adjustment. The attachment is mountable to a variety of firearms and may be removed without permanent stock modifications.

U.S. Pat. No. 4,769,937 issued to Gregory et al. is for a pneumatic recoil reduction in device fitted into the but end of a shotgun stock. An air cylinder is located closest to the butt end permitting adjusting the pressure in the cylinder without disassembly.

Gregory in U.S. Pat. No. 4,896,446 discloses an adjustable comb and butt plate for shoulder firearms consisting of a butt plate with recoil absorbing means and a combined slideable and removable comb. The butt plate permits length and/or a different pitch down angle with means accessible from the exterior of the stock.

U.S. Pat. No. 5,031,348 of Carey is for a gun stock and a recoil assembly, the comb piece and a shoulder piece remain stationary during shooting while the recoil assembly absorbs the recoil.

Kennel in U.S. Pat. No. 5,075,995 teaches a gunstock which includes a contoured pistol handgrip face engaging portion and longitudinal stock cast enabling the user to absorb the recoil with a uniform sighting position.

U.S. Pat. No. 5,711,102 issued to Plaster et al. is for a configurable sniper rifle stock having a wide forearm and narrow carrying portion with the action mounted rearward. A stippled grip and a interchangeable cheek piece on the butt stock, with spacers used to adjust the length of pull.

Fitzpatrick et al. in U.S. Pat. No. 7,152,355 B2 disclose a modular stock system replacing a rifle buffer tube with one containing a mount for constant cheek weld and a rail track for adjustment. A stock module mounts on the replacement buffer tube and is interchangeable with fixed and specialized stocks.

U.S. Pat. No. 7,762,018 B1 also of Fitzpatrick et al. is for a modular gunstock for AR15/M16 rifles having a receiver extension tube with a sleeve slideable over the attachment which contains mounting structure. The module is adjustable for length and features a length pre-set system, a latch with independent dual-pawls, an integrated impact buffer, modular tail-piece and storage also a position selectable fixed cheek plate.

For background purposes and as indicative of the art to which the invention is related reference may be made to the remaining cited patents issued to Apel in U.S. Pat. No. 6,467,212 B2, Fitzpatrick et al. in U.S. Pat. No. 7,647,719 B2 and Popikow in U.S. Pat. No. 7,536,819 B2.

BRIEF SUMMARY OF THE INVENTION

Commercial gun stocks are made in production to fit the average right handed shooter whereas specialized stock makers have the ability to change the dimensions of a stock to fit the exact anatomy of the owner. There are a number of areas that may be taken into consideration to make the perfect fit which changes the entire dynamics of the firearm. A shooter may bring the specialized stock to the shoulder and repeatably find the exact head position to accommodate the gun sight, have the cheek weld comfortable, the trigger finger at the optimum position and the recoil pad at the most advantageous location.

There has been a long felt need to have the capability to custom fit a buttstock either by the original manufacturer, when the appropriate information is known, or by the owner in the field using adjustments available within the buttstock itself.

There are three dimensions to be considered that are the most important, basically the length of the stock, the bend or drop of the stock relative to the centerline and the cast either to the right or left of center. In the past the stock length problem has been overcome the field by physically shortening the stock by cutting off the material or adding a spacer or a thicker butt plate or recoil pad to increase the length. The drop and cast are not really practical to overcome in a commercial stock however attempts have been made by offsetting the butt plate or recoil pad to somewhat compensate.

Another problem of stock fit is the length of ones trigger finger which has to do with ones grasp on the pistol grip relative to the trigger. This is one area not always considered which should be included in the perfect fit of a buttstock for a gun as the finger should be aligned with the direction of travel if is not trigger pulls may be pushed or pulled sideways before sear release. Some expensive shotguns actually have a trigger that is adjustable forward and aft to accommodate this feature.

The instant invention includes all of the basic fit adjustments as well as even more alternative definitive alterations.

It is therefore a primary object of the invention to enable the length of pull to be easily adjusted in the field by rotating the recoil pad mounting threaded shaft and secure it with a lock nut and a jam nut. Both of the nuts contain peripheral holes in which a furnished hex wrench may be inserted for tightening.

An important object of the invention to change the drop of the stock, measured from the center of the barrel to heel of stock which is accomplished by rotating or adding tapered washers to the set of two serrated grip retainers positioned within the grip neck.

Another object of the invention is the stock cast which is defined as the set of the buttstock relative to the bore centerline which is "cast off" when the stock is right of center and "cast on" when left of center. The adjustment is accomplished by relieving the tension with a lock ring and rotating or adding tapered washers to the set of two serrated grip retainers which changes the angle of the buttstock starting at the grip neck.

A defining feature of the invention is the adjustment of the buttstock tilt which is the angular displacement from the vertical centerline of the stock. The adjustment is accomplished by manually rotating the buttstock permitting the slip clutch to re-engage in essentially 4.5 degree increments. The slip clutch is spring loaded permitting the stock to be pulled away from the mass of the firearm and rotated with the serrated teeth of the grip retainers meshing under the urging of the spring when released.

A second defining feature is the adjustment of the trigger grip length, which is measured from a trigger to midpoint of the pistol grip. This adjustment is made by omitting or adding flat spacers to the set of two serrated grip retainers preferably between the first retainer, and the flange of the flanged stock bolt.

Still another object of the invention is the adjustment of the recoil pad slant or bias, relative to the bore centerline. This adjustment accomplished by attaching the threaded shaft to the adapter plate at the desired taper of the end of the shaft. If the slant is not required one end of the shaft is flat and may be attached at right angles. A second threaded shaft may be provided with a different angle on each end to permit the optimum angle to be selected.

Yet another object of the invention permits the recoil pad height to be altered in relation to the stock heel. This object is realized by moving the recoil pad up or down by locating the attaching screws in the appropriate threaded hole pattern contained within the adapter plate.

A further object of the invention is the ability to adjust the recoil pad angular position, relative to the stock vertical centerline which is accomplished by rotating the threaded shaft in or out of the buttstock and securing the shaft with a lock nut and a jam nut thereby permitting 360 degree rotation.

A final object of the invention is that the entire buttstock is made exclusively of aluminum with the exception of the grip retainers, flanged stock bolt, spring, retainers, nuts, and threaded fasteners which are metallic. The advantages of an aluminum stock material are easily understood as the material is impervious to weather, stable in temperature and humidity, can be hard anodized in a variety of colors and aluminum has great structural integrity. It is anticipated that an all aluminum fore stock could be attached to the second grip retainer to complete an entire gun stock having the same utilitarian advantages as well as action bedding positive interface lock up.

These and other objects and advantages of the present invention will become apparent from the subsequent detailed description of the preferred embodiment and the appended claims taken in conjunction with the accompanying drawings.

DETAILED DESCRIPTION OF THE INVENTION

Figure 1:
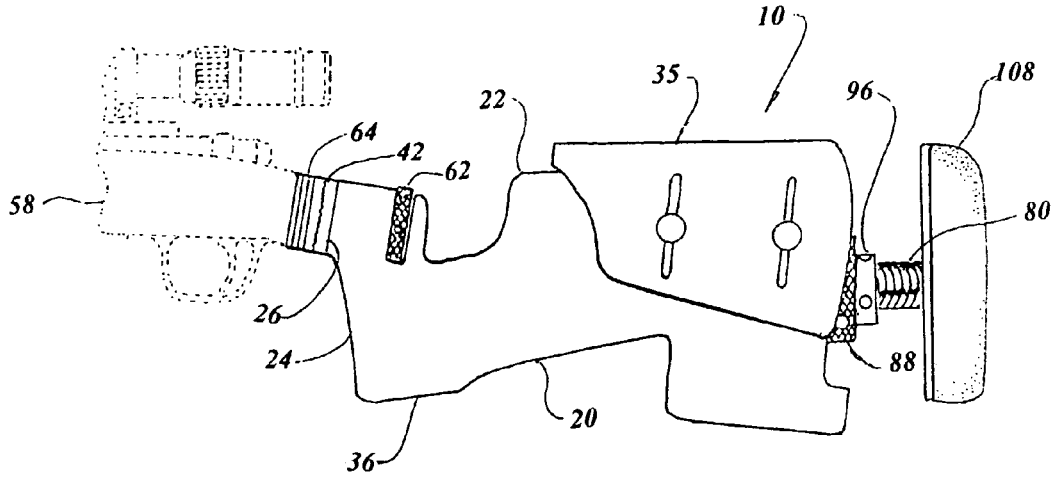
FIG. 1 is a left side view of an aluminum rifle buttstock in the preferred embodiment.
Figure 2:
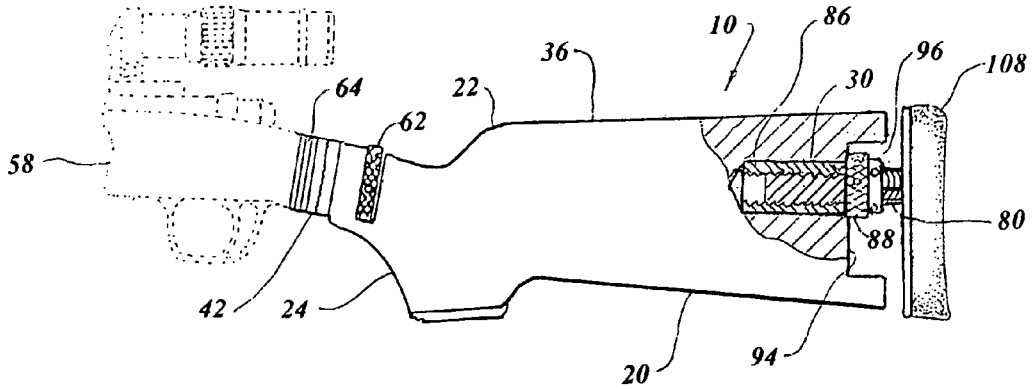
FIG. 2 is a left side view of a wood rifle buttstock in the preferred embodiment.
Figure 6:
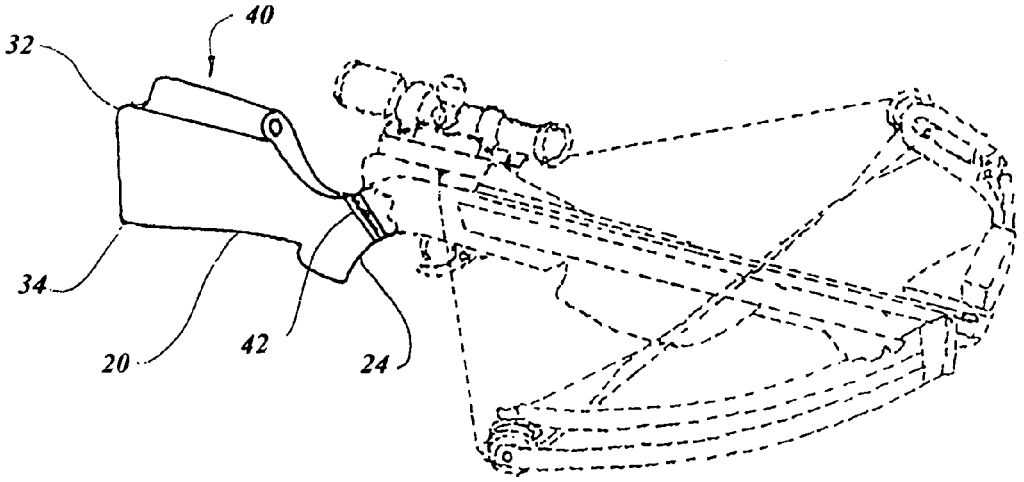
FIG. 6 is a partial isometric view of a cross bow in the preferred embodiment.
Figure 7:
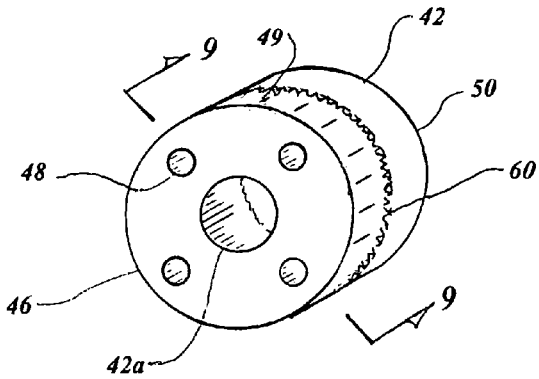
FIG. 7 is a partial isometric view of the interfaced set of two serrated grip retainers in the preferred embodiment.
Figure 8:
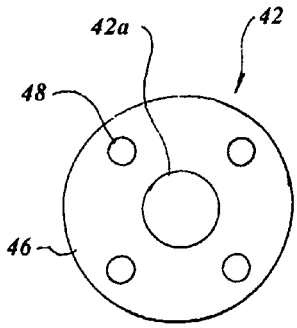
FIG. 8 is a left side view of the interfaced set of two serrated grip retainers in the preferred embodiment.
Figure 9:
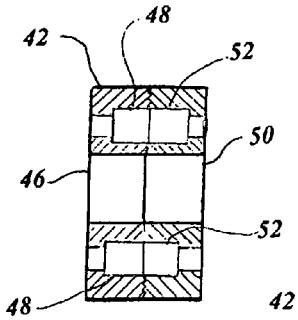
FIG. 9 is a cross sectional view taken along lines 9-9 of FIG. 7.
Figure 10:
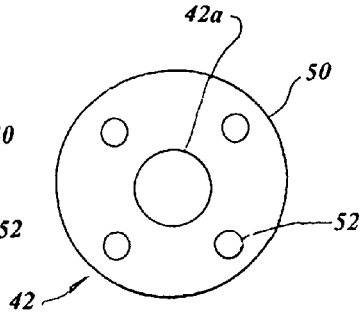
FIG. 10 is a right side view of the interfaced set of two serrated grip retainers in the preferred embodiment.

The best mode for carrying out the invention is presented in terms of a preferred embodiment. This preferred embodiment of a multi-axis adjustable buttstock 10 is shown in FIGS. 1 thorough 41 and is comprised of a buttstock 20, having, a comb 22, a pistol grip 24, a grip neck 26, and a butt 28 including a plurality of bores 30 therein, and the butt 28 defined having a heel 32 and a toe 34. The function of the multi-axis adjustable buttstock 10 may be incorporated with various materials and utility which include a rifle 36, as illustrated in FIGS. 1, 2, 4, 5 and 35-41, a shotgun 38, shown in FIG. 3 and a cross bow 40 depicted in FIG. 6. While aluminum material is preferred the same adjustments may be incorporated with other metallic materials including, wood, epoxy, wood laminate, fiberglass, thermoplastic, or polymer resin for the buttstock 20.

Figure 36:
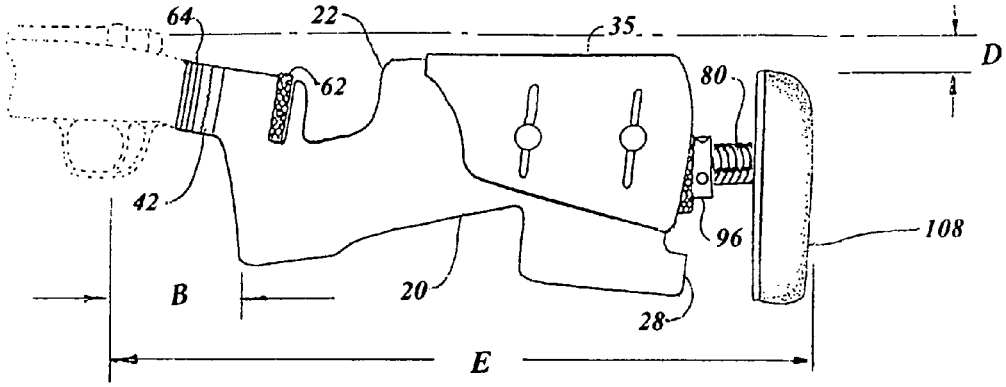
FIG. 36 is a side view of the buttstock illustrating the length pull adjustment E, the buttstock drop D and the trigger grip length adjustment B, in the preferred embodiment.
Figure 37:
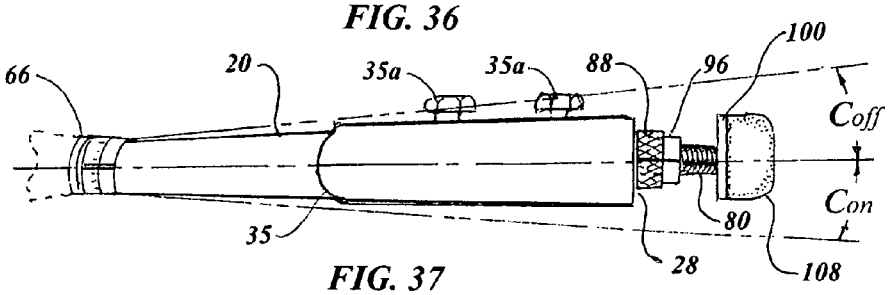
FIG. 37 is a top view of the buttstock illustrating the cast on and cast off adjustment C, in the preferred embodiment.

An adjustable cheekpiece 35 is attached to the buttstock 20, as illustrated in FIGS. 1, 36, 38 and 40, which maybe easily adjusted longitudinally, laterally or angularly utilizing a pair of screws and hand nuts 35*a* with the nuts positioned on the distal side of the cheekpiece 35 as depicted in FIG. 37.

Where metallic materials are utilized all of the bores 30 may be threaded and when non-metallic materials are employed a female threaded sleeve 86 may be required. At least four bores 30 are preferred with two in the middle providing a choice of which one to be used according to the desired height configuration of the buttstock for personal comfort and utility. The remaining bores 30 in the toe 34 and heel 32 may be used for storage with a threaded plug 30*a* for closure.

A flanged stock bolt 72 is disposed through a portion of the buttstock 20, as illustrated in FIGS. 1-5 used for interfacing with a firearm segment 58 such as a stock forearm or a firearm action. The flanged stock bolt 72 is illustrated in the cross section view of FIG. 15 consisting of a flange 72*a*, a shaft 72*b*, a distal threaded end 72*c* and a firearm attaching screw hole 54*a*.

Figure 11:
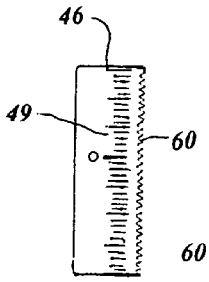
FIG. 11 is left side view of the first retainer with a bolt clearance hole in the preferred embodiment.
Figure 15:
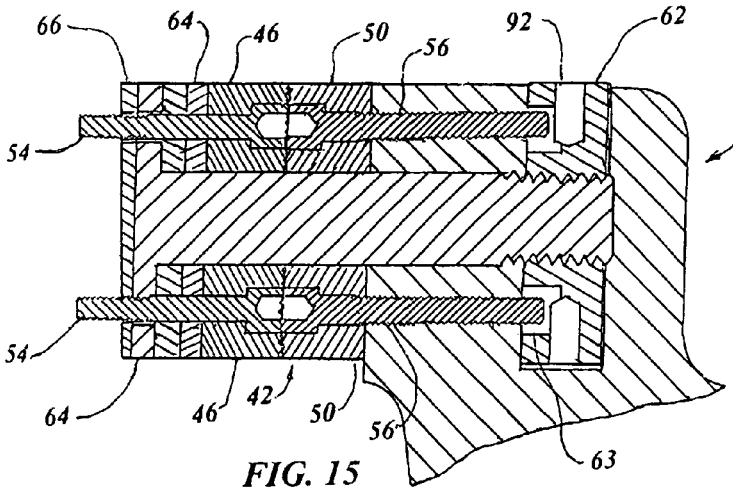
FIG. 15 is a cross sectional view taken along an imaginary centerline of the flanged stock bolt, a flat grip spacer, a tapered grip spacer, the first grip retainer and threaded fasteners for attachment to a firearm segment, a second grip retainer with threaded fasteners for attaching said buttstock and a first lock ring with the buttstock illustrated partially where interfaced with the above elements.

An interfaced set of two, preferably steel, serrated grip retainers 42, illustrated separate in FIGS. 7-14, are removeably positioned onto the flanged stock bolt 72 for tilt adjustment of the buttstock 20, which is achieved by manual rotation of the buttstock 20 when the grip retainers 42 serrations 60 are separated. A first grip retainer 46 of the set of two serrated grip retainers 42 include a plurality of first recessed holes 48 for attachment to a firearm segment 58 with firearm attaching screws 54 and includes angle adjustment indicia 49 on an outside peripheral surface, as illustrated in FIG. 11. A second grip retainer 50 has a plurality of second recessed holes 52 for attachment to the buttstock grip neck 26 with stock attaching screws 56, as illustrated in FIG. 15.

Figure 12:
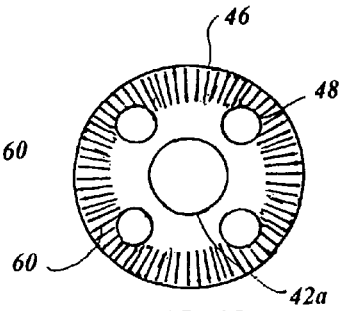
FIG. 12 is serrated face view of the first retainer with a bolt clearance hole in the preferred embodiment.
Figure 13:
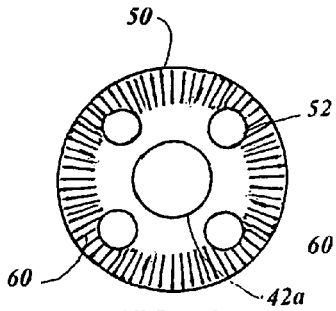
FIG. 13 is serrated face view of the second retainer having a bolt threaded hole in the preferred embodiment.
Figure 14:
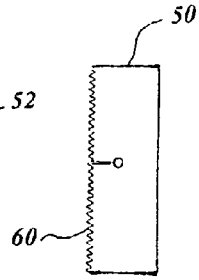
FIG. 14 is right side view of the second retainer with a bolt threaded hole in the preferred embodiment.

The first grip retainer 46 and second grip retainer 50 both have serrated teeth 60 on the face that are indexed at no more than 4.5 degree increments, as depicted in FIGS. 12 and 13. Threaded stock attaching screws 56 are preferred for aluminum buttstocks 20, as illustrated in FIG. 15; however wood screws, not shown but well known in the art, may be used for buttstocks 20 of wood and other synthetic materials.

Figure 39:
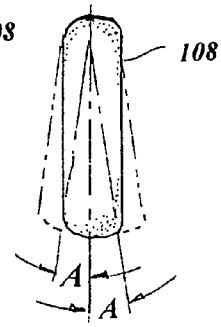
FIG. 39 is a butt end view of the buttstock illustrating the buttstock tilt adjustment A, in the preferred embodiment.
Figure 40:
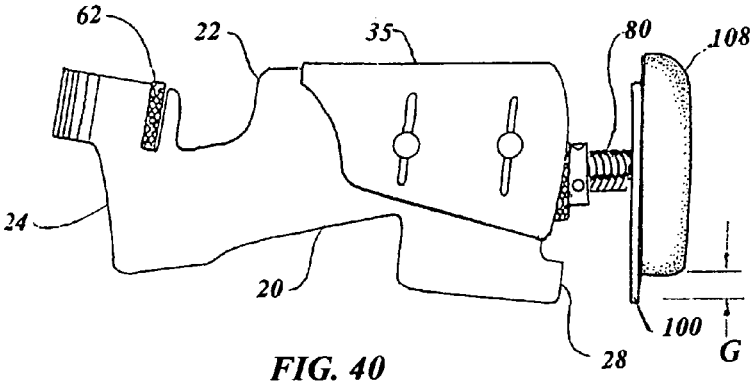
FIG. 40 is a side view of the buttstock illustrating the recoil pad height adjustment G, in the preferred embodiment.

Adjustment of the buttstock tilt, designated A in FIG. 39 or the angular displacement from vertical is accomplished by manually rotating the buttstock 20 after tension is released to disengage the in the 4.5 degree increments.

Figure 16:
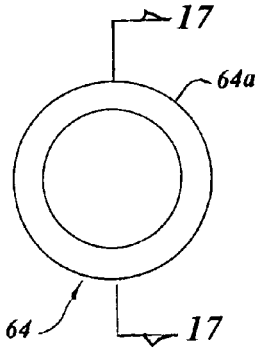
FIG. 16 is a cross sectional view taken along lines 16-16 of FIG. 17.
Figure 17:
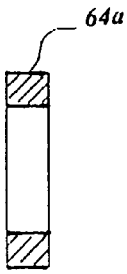
FIG. 17 is a front view of one of the flat grip spacers rotatably held in place with stock attaching screws.
Figure 18:
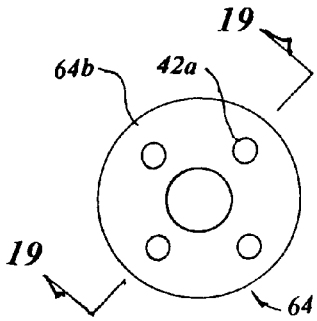
FIG. 18 is front view of one of the flat grip spacers with clearance holes in the preferred embodiment.
Figure 19:
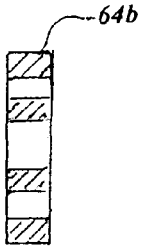
FIG. 19 is a cross sectional view taken along lines 19-19 of FIG. 18.

A plurality of selectable flat grip spacers 64 and tapered grip spacers 66 engaging the grip serrated retainers 42 are used for adjustment by the addition and orientation of selected spacers 64 and 66 positioned between the grip neck 26 and at least one side of the set of serrated grip retainers 42. Optionally there are two separate types of flat grip spacers 64, FIGS. 16 and 17 illustrate a flat grip spacer 64*a* having an inside diameter large enough to rotate freely on the inboard surface of the firearm attaching screws 54 and the flat grip spacer 64*b*, depicted in FIGS. 18 and 19 utilize the same firearm attaching screws 54 through matching first recessed holes 48 of the serrated grip retainers 42.

Figure 20:
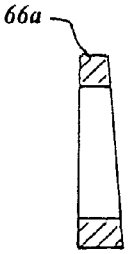
FIG. 20 is a cross sectional view taken along lines 20-20 of FIG. 21.
Figure 21:
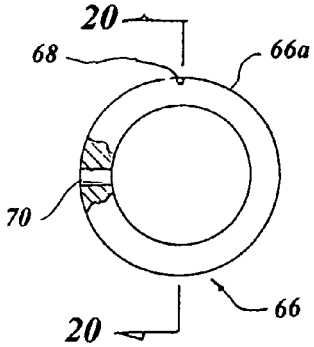
FIG. 21 is front view of one of the tapered grip spacers rotatably held in place with screws.
Figure 22:
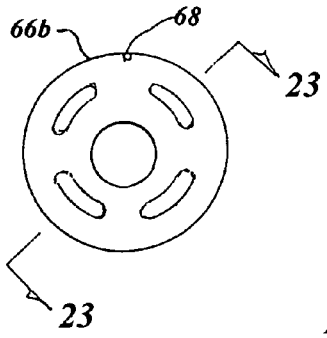
FIG. 22 is front view of the tapered grip spacer with a bolt clearance holes
Figure 23:
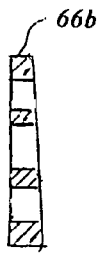
FIG. 23 is a cross sectional view taken along lines 23-23 of FIG. 22.
Figure 24:
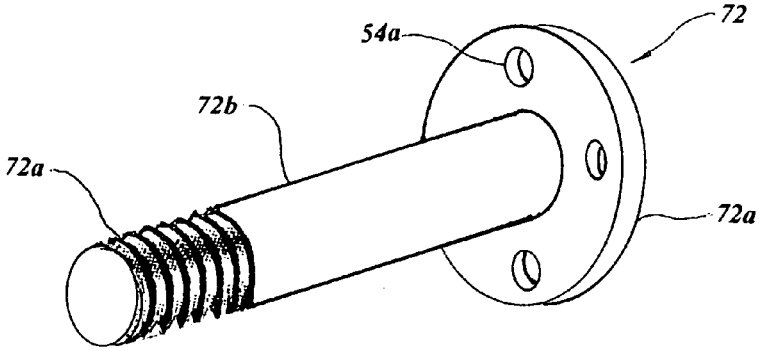
FIG. 24 is a partial isometric view of the flanged stock bolt.
Figure 25:
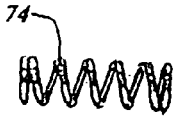
FIG. 25 is a partial isometric view of an optional compression spring in the preferred embodiment.

Likewise there are two separate tapered grip spacers 66, FIGS. 20 and 21 illustrate a tapered grip spacer 66*a* having an inside diameter large enough to rotate freely on the inboard surface of the firearm attaching screws 54. The tapered grip spacer 66*b*, depicted in FIGS. 22 and 23 utilize the same firearm attaching screws 54 through matching screw first recessed holes 48 of the serrated grip retainers 42.

The tapered grip spacers 66*a* and 66*b* have an indexing mark 68 and optionally a plurality of wrench holes 70 on a peripheral surface for tensioning with a hex wrench. The tapered grip spacers 66*b* have slots 69 to mate with the firearm attaching screws 54.

It will be noted that the combination and location of flat grip spacers 64 and tapered grip spacers 66 may vary considerably other groupings still fall well within the scope of this disclosure. A first threaded lock ring 62 has a recessed indentation 63 on one side permitting the stock attaching screws 56 to protrude therein without physical contact providing a captive joint when the flanged stock bolt 72 is removed from the buttstock 20 and self centers the flanged stock bolt 72 when replaced.

Figure 15A:
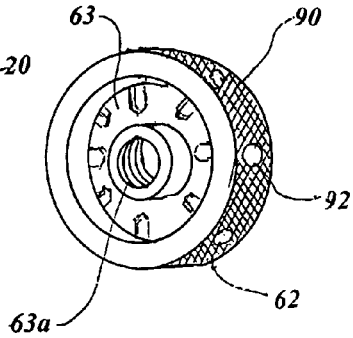
FIG. 15*a* is a partial isometric view of the first lock nut, in the preferred embodiment.
Figure 29:
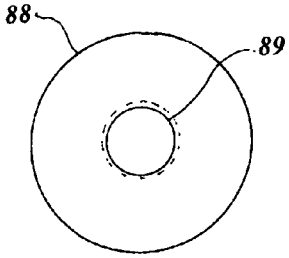
FIG. 29 is a front view of the second lock nut, in the preferred embodiment.
Figure 30:
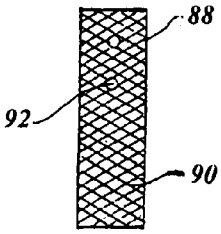
FIG. 30 is a side view of the second lock nut, in the preferred embodiment.
Figure 31:
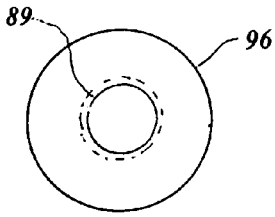
FIG. 31 is a front view of the jam nut, in the preferred embodiment.
Figure 32:
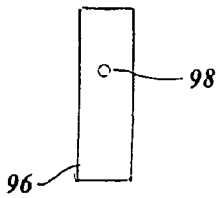
FIG. 32 is a side view of the jam nut, in the preferred embodiment.
Figure 33:
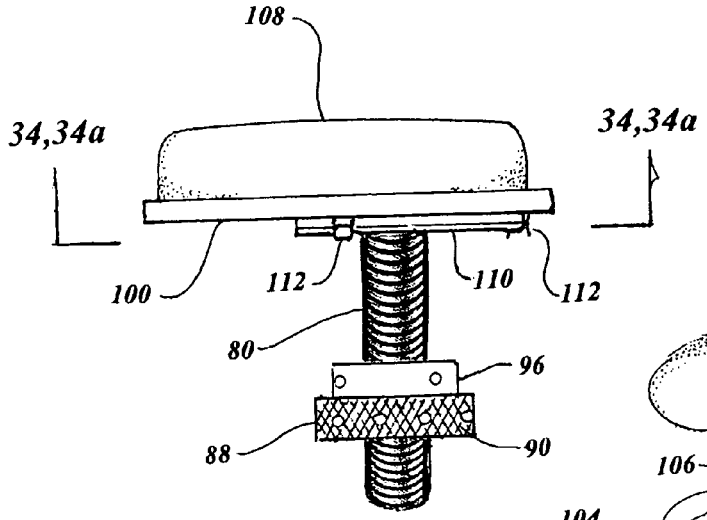
FIG. 33 is a partial isometric view of the recoil pad assembly in the preferred embodiment.

This first threaded lock ring 62, depicted in FIG. 15*a*, engages the threaded end 72*c* of the flanged stock bolt 72 compressing and locking the set of two serrated grip retainers 42 and optionally flat and/or tapered spacers, 64 and/or 66, after adjustment has been accomplished. The first threaded lock ring 62 is illustrated in FIGS. 15-15*a* and is basically configured the same as a second threaded lock ring 88 illustrated in FIGS. 29 and 30 except for its reduced size. The first threaded lock ring 62 includes the same lock ring holes 92 and knurling 90 as the second threaded lock ring 88.

FIG. 39 depicts the tilt adjustment of the entire buttstock 20 designated A which is accomplished by loosing the tension on the set of two grip retainers 42 and manually rotating the tilt by disengaging the serrations 60 in the 4.5 degree, or less, increments. The adjustment of the trigger grip length, illustrated in FIG. 36, designated B is provided by the addition of one or more flat grip spacers 64 increasing the original minimum spacing. FIG. 37 shows the cast adjustment Coff or Con which is made by the addition of a tapered grip spacer 66 at the appropriate angle of rotation.

Figure 26:
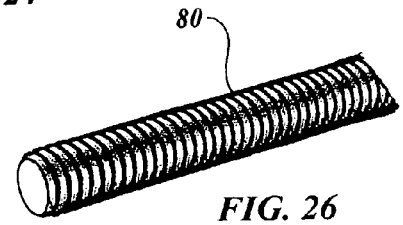
FIG. 26 is a partial isometric view of the threaded rod in the preferred embodiment.
Figure 27:
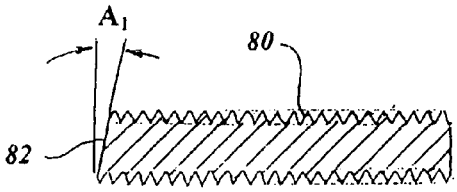
FIG. 27 is a side view of the threaded rod having an angle on one end, in the preferred embodiment.
Figure 28:
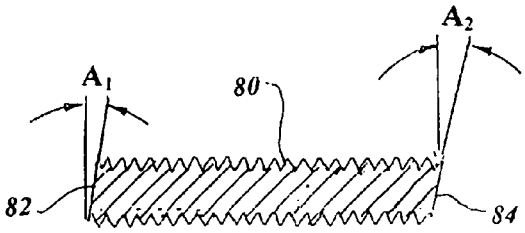
FIG. 28 is a side view of the threaded rod having an angle on both ends, in the preferred embodiment.

A threaded rod 80, illustrated in FIGS. 26-28, have a first end 82 and a second end 84 which is threadably inserted into one of the bores 30 in the buttstock 20 a desired distance for regulating buttstock length of pull, measured from trigger to end of stock, designated E in FIG. 36. The first end 82 may be slanted 0 to 25 degrees, designated $A_1$, and the second end 84 may be slanted 0 to 10 degrees, designated $A_2$, in FIG. 28, in any event at least one end could be flat or 0 degrees. Two or more separate rods 80 may be supplied to provide a precise slant angle. The rod 80 material may be stainless steel, carbon steel, titanium, or even aluminum, with steel preferred.

Figure 3:
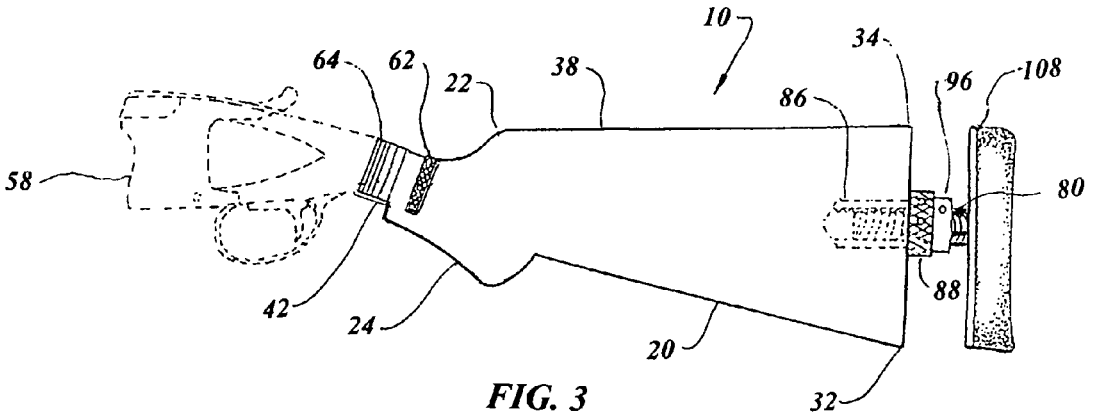
FIG. 3 is a left side view of a wood shotgun buttstock in the preferred embodiment.
Figure 4:
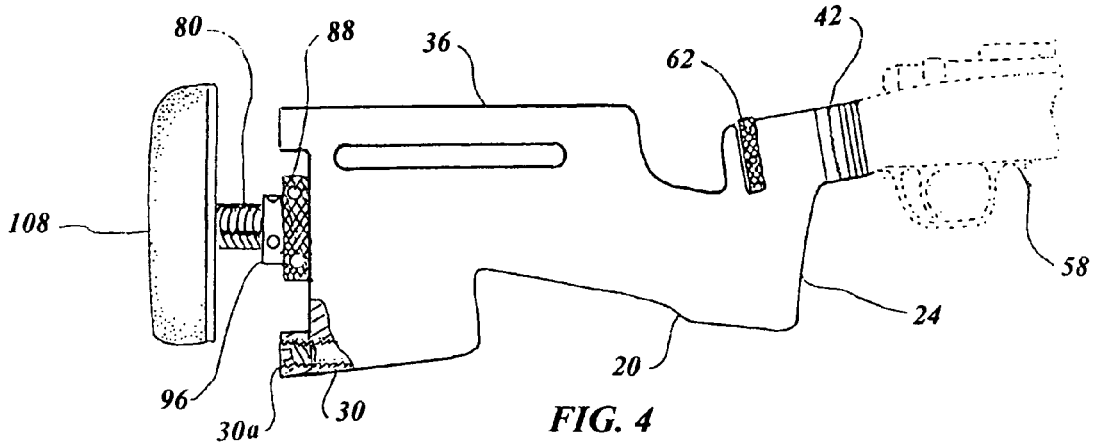
FIG. 4 is a left side view of an aluminum rifle buttstock, less cheekpiece, with sections cut away to illustrate internal components.
Figure 5:
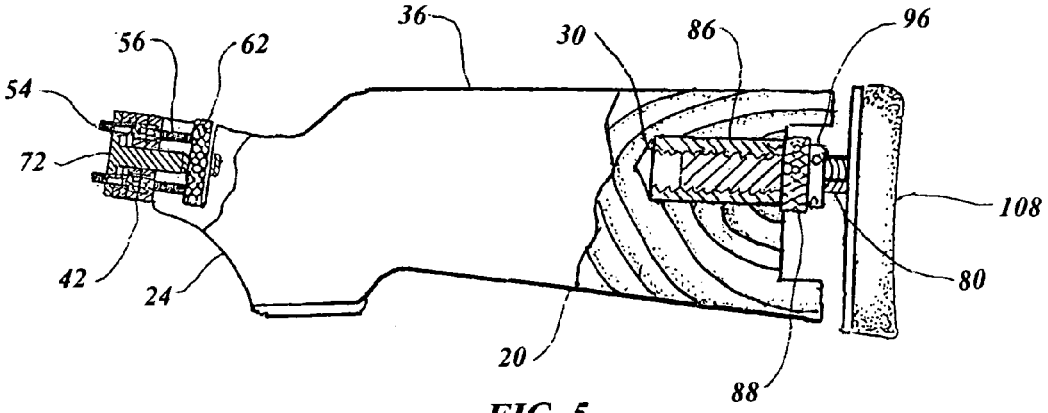
FIG. 5 is a left side view of a wood rifle buttstock, less cheekpiece, with sections cut away to illustrate internal components.

The second lock ring 88 is positioned on the threaded rod 80 and embraces the buttstock 20 assuring a robust connection. The threaded second lock ring 88 may include knurling 90 and a plurality of lock ring holes 92 on the peripheral surface for final tightening with a hex wrench. The threaded second lock ring 88 engages the butt 28 either flush with the butt 28, as illustrated in FIG. 3 or within recess 94 within the butt 28, as shown in FIGS. 1, 2, 4 and 5. A threaded jam nut 96 is situated on the threaded rod 80 and interfaces with the second lock ring 88 for positive securement and plurality of jam nut holes 98 may be located on the peripheral surface of the jam nut 96 used for tightening the jam nut 96 with a provided hex wrench 110.

Figure 38:
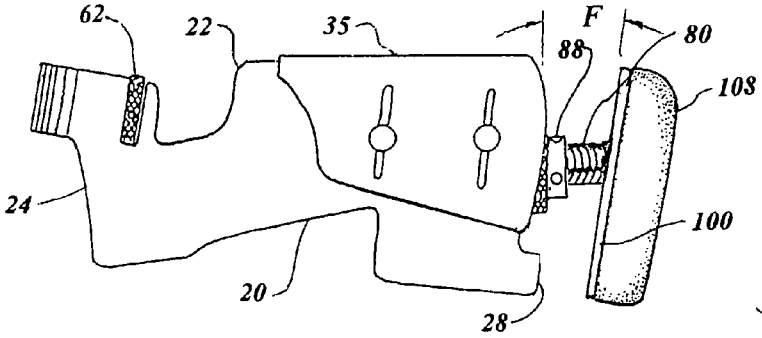
FIG. 38 is a side view of the buttstock illustrating the recoil pad slant adjustment F, in the preferred embodiment.

A recoil pad adapter plate 100 contains a plurality of concentric holes 102 for attachment to a selected first end 82 or second end 84 of the threaded rod 80 providing recoil pad slant, designated F in FIG. 38. The adapter plate 100 also includes a plurality of threaded recoil pad holes 104 in angled linear arrays as shown clearly in FIGS. 34, **34*a* and 35. A plurality of threaded fasteners 106 are utilized for attaching the adapter plate 100 to the threaded rod 80 through the concentric holes 102 and a recoil pad 108 is attached with the threaded fasteners 106 into the plurality of threaded recoil pad holes 104 in angled linear arrays in the adapter plate 100**.

An alternate embodiment for the adapter plate 100 is illustrated in FIG. **34*a* and is basically the same except the concentric holes 102 are in parallel linear arrays in the adapter plate 100 and only two recoil pad holes 104 are utilized. This alternate embodiment is particularly useful in applications were a shotgun buttstock 38** is employed.

Figure 34:
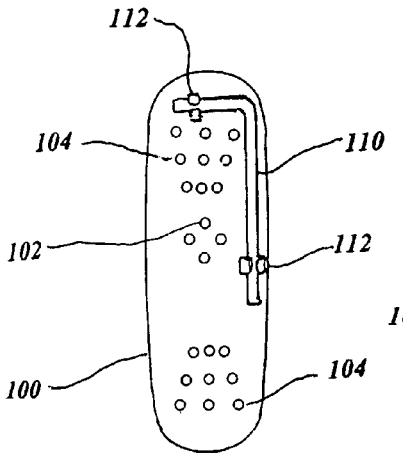
FIG. 34 is a view taken along lines 34-34 of FIG. 33.
Figure 34A:
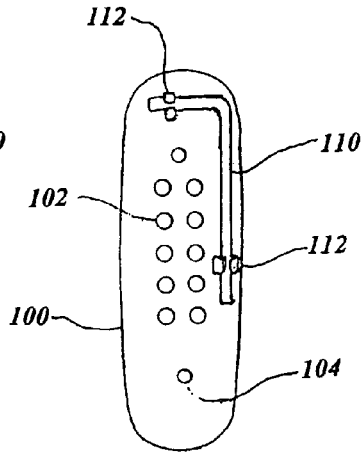
FIG. 34*a* is a view taken along lines 34*a*-34*a* of FIG. 33 illustrating an alternate embodiment of the concentric holes in the recoil pad adapter plate.
Figure 35:
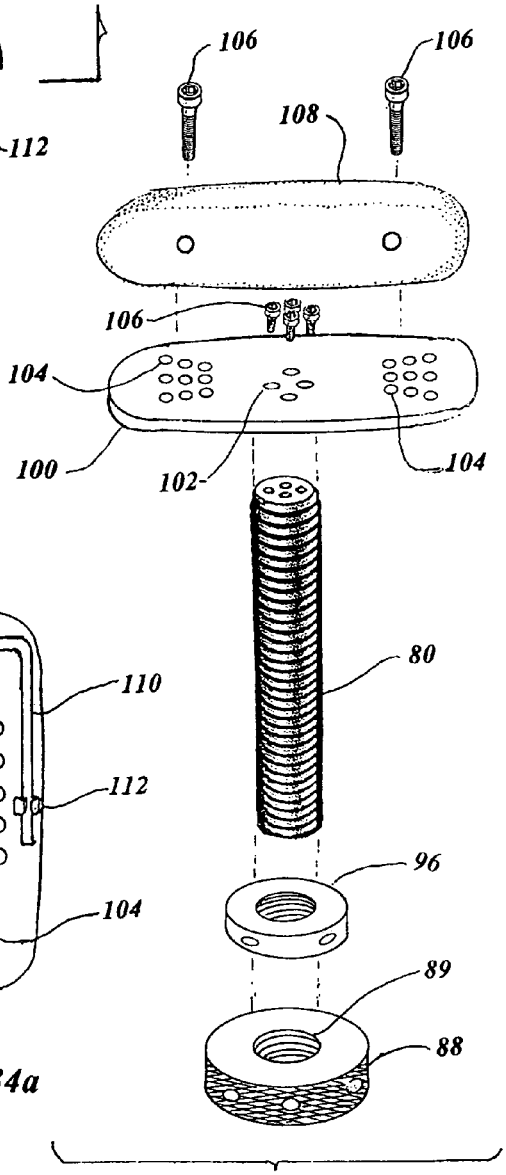
FIG. 35 is an exploded view of the recoil pad assembly in the preferred embodiment.
Figure 41:
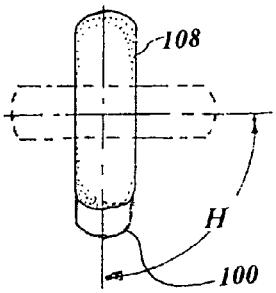
FIG. 41 is a butt end view of the buttstock illustrating the recoil pad angle adjustment H, in the preferred embodiment.

The recoil pad adapter plate 100 is made of aluminum, carbon steel or titanium with aluminum preferred; also the hex wrench 110 with mounting clips 112 is attached to the underside of the recoil pad adapter plate 100, as shown in FIG. 34. The recoil pad 108 is attached to the adapter plate 100 with threaded fasteners 106, either countersunk heads or socked heads aligned with selected recoil pad holes 104 providing recoil pad height adjustment designated G in FIG. 40. Recoil pad angle adjustments, designated H in FIG. 41 are produced by rotation of the threaded rod 80 permitting a 360 degree alignment relative to the butt 28.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

ADDENDUM
MULTI-AXIS ADJUSTABLE BUTTSTOCK
Element Designation
(For convenience only, not necessarily part of the specification)

| | |
|---|---|
| 10 | multi-axis adjustable buttstock |
| 20 | buttstock |
| 22 | comb |
| 24 | pistol grip |
| 26 | grip neck |
| 28 | butt |
| 30 | bore (in 28) |
| 30a | threaded plug (in 30) |
| 32 | heel |
| 34 | toe |
| 35 | adjustable cheekpiece |
| 35a | screws and hand nuts (for 35) |
| 36 | rifle buttstock |
| 38 | shotgun buttstock |
| 40 | cross bow buttstock |
| 42 | set of 2 grip retainers |
| 42a | stock bolt clearance hole |
| 46 | first grip retainer |
| 48 | first recessed holes (in 46) |
| 49 | angle adjustment indicia |
| 50 | second grip retainer |
| 52 | second recessed holes (in 50) |
| 54 | firearm attaching screws (in 48) |
| 56 | stock attaching screw (in 52) |
| 58 | firearm segment |
| 60 | serrated face (of 46 and 50) |
| 62 | first threaded lock ring |
| 63 | recessed indentation (in 62) |
| 63a | threaded bore (in 62) |
| 64 | flat grip spacer |
| 64a | flat grip spacer (inside diameter) |
| 64b | flat grip spacer (screw holes) |
| 66 | tapered grip spacer |
| 66a | tapered grip spacer (inside diameter) |
| 66b | tapered grip spacer (screw slots) |
| 68 | index mark (on 66a and 66b) |
| 69 | screw slots (in 66b) |
| 70 | wrench holes (in 66a and 66b) |
| 72 | flanged stock bolt |
| 72a | flange (of 72) |
| 72b | shaft (of 72) |
| 72c | threaded end (of 72) |
| 74 | compression spring (in 20) |
| 80 | threaded rod |
| 82 | first end (of 80) |
| 84 | second end (of 80) |
| 86 | threaded sleeve |
| 88 | second lock ring |
| 89 | threaded bore (in 88 and 96) |
| 90 | knurling (on 62 and 88) |
| 92 | lock ring holes (in 88) |
| 94 | recess (within 28) |
| 96 | jam nut (on 80) |
| 98 | jam nut holes (in 96) |
| 100 | recoil pad adapter plate |
| 102 | concentric holes (in 100) |
| 104 | threaded recoil pad holes (in 100) |
| 106 | threaded fasteners |
| 108 | recoil pad |
| 110 | hex wrench (on 100) |
| 112 | mounting clip (for 110) |

The invention claimed is:

1. A multi-axis adjustable buttstock which comprises;

a buttstock, having, a grip neck, and a butt, a flanged stock bolt, disposed through a portion of said buttstock for interfacing with a firearm segment, an interfaced set of two serrated grip retainers attached onto said flanged stock bolt, for buttstock tilt adjustment, a plurality of selectable flat and tapered grip spacers attached on said flanged stock bolt engaging at least one of said two serrated grip retainers for trigger grip length, cast and drop adjustment of said buttstock, a threaded rod inserted into said butt of said buttstock a desired distance for length of pull adjustment, a threaded lock ring positioned on said threaded rod for securement, a recoil pad adapter plate having a plurality of concentric holes attached to said threaded rod, for recoil pad slant adjustment, and a recoil pad attached to said adapter plate aligned with selected recoil pad holes for recoil pad height and angle adjustments.

2. A multi-axis adjustable buttstock which comprises;

a buttstock, having, a comb, a grip neck, and a butt having a plurality of bores therein with said butt further defined as having a heel and a toe, a flanged stock bolt disposed through a portion of said buttstock for interfacing with a firearm segment, an interfaced set of two serrated grip retainers removeably positioned onto said flanged stock bolt for tilt adjustment of said buttstock achieved by manual rotation of said buttstock when said grip retainers serrations are separated, wherein a first grip retainer of said set of two serrated grip retainers have a plurality of recessed holes for attachment to a firearm segment with stock attaching screws, and a second grip retainer having a plurality of recessed holes for attachment to said buttstock grip neck, a plurality of selectable flat and tapered grip spacers for adjusting trigger grip length, buttstock cast and buttstock drop by an addition and orientation of selected flat and/or tapered spacers between said stock bolt flange and said grip neck, a first threaded lock ring engages said flanged stock bolt compressing and locking said set of two serrated grip retainers after adjustment has been accomplished, a threaded rod having a first end and a second end, threadably inserted into said buttstock a desired distance for regulating buttstock length of pull, a second threaded lock ring is positioned onto said threaded rod embracing said buttstock thereby assuring a secure rod position, a recoil pad adapter plate having a plurality of concentric holes for attachment to said selected first end or second end of said threaded rod providing recoil pad slant, wherein said adapter plate having a plurality of threaded recoil pad holes in angled linear arrays, and a recoil pad attached to said adapter plate aligned with selected plurality of threaded recoil pad holes providing recoil pad height adjustment, and recoil pad angle adjustments produced by rotation of said threaded rod permitting a 360 degree alignment relative to said butt.

3. The multi-axis adjustable buttstock as recited in claim 2 wherein said buttstock has a configuration selected from the group consisting of a rifle, a shotgun and a cross bow, and said buttstock utilizes a material selected from the group consisting of aluminum, wood, epoxy wood laminate, fiberglass, thermoplastic and polymer resin.

4. The multi-axis adjustable buttstock as recited in claim 2 further comprises an adjustable cheekpiece with said buttstock having a longitudinal slot adjacent to said comb and said cheekpiece having a plurality of vertical slots wherein a plurality of through bolts with finger nuts connect said cheekpiece to said buttscock in a vertical, horizontal and angular orientation.

5. The multi-axis adjustable buttstock as recited in claim 2 wherein said buttstock bores are threaded with at least two capable of accommodating said threaded rod for height adjustment and at least one bore positioned at said toe and one positioned at said heal with each toe and heal bore having a threaded plug therein.

6. The multi-axis adjustable buttstock as recited in claim 2 wherein said interfaced set of two serrated grip retainers are indexed at no more than 4.5 degree increments and each retainer having a plurality of screw clearance holes on a concentric bolt circle and head clearance recesses, wherein said retainers are steel.

7. The multi-axis adjustable buttstock as recited in claim 2 further comprising a plurality of stock attaching screws wherein said interfaced set of two serrated grip retainers are attached to said buttstock and a forestock with the stock attaching screws disposed through each retainer screw clearance hole.

8. The multi-axis adjustable buttstock as recited in claim 2 wherein said tapered grip spacers further having an inside diameter large enough to rotate freely on said stock attaching screws with the tapered grip spacer providing required angular adjustment of said buttstock.

9. The multi-axis adjustable buttstock as recited in claim 2 wherein said first lock ring and said second lock ring each having knurling and a plurality of wrench holes on a peripheral surface for tensioning with a hex wrench, wherein said first lock ring having a recessed indentation on one side permitting said stock attaching screws to protrude therein without contact providing a captive joint when said flanged stock bolt is removed from the buttstock and self centers the flanged stock bolt when replaced.

10. The multi-axis adjustable buttstock as recited in claim 2 wherein said set two grip retainers each further having indexing indicia markings.

11. The multi-axis adjustable buttstock as recited in claim 2 further comprising a female threaded sleeve securely contained within said bore in said butt for receiving said threaded rod for length of pull adjustment for a non-metallic buttstock and threaded bores for a metal buttstock.

12. The multi-axis adjustable buttstock as recited in claim 2 wherein said threaded rod first end is angled from 0 to 25 degrees and said second end is angled from 0 to 10 degrees with said rod of a material selected from the group consisting of stainless steel, carbon steel, titanium, and aluminum.

13. The multi-axis adjustable buttstock as recited in claim 2 wherein said threaded lock ring engages said butt at a position selected from the group consisting of flush with the butt and within a recess within said butt.

14. The multi-axis adjustable buttstock as recited in claim 2 further comprising a threaded jam nut situated on said threaded rod interfacing with said lock ring providing positive securement and said jamb nut having a plurality of jam nut holes on a peripheral surface thereof for tightening with a hex wrench.

15. The multi-axis adjustable buttstock as recited in claim 2 further comprises a plurality of threaded fasteners for attaching said adapter plate to said threaded rod into said concentric holes and said recoil pad attached with said threaded fasteners into said plurality of threaded recoil pad holes in angled linear arrays in said adapter plate.

16. The multi-axis adjustable buttstock as recited in claim 2 wherein said recoil pad adapter plate having a plurality of concentric holes, consists of a material selected from the group consisting of aluminum, carbon steel and titanium.

17. The multi-axis adjustable buttstock as recited in claim 2 further comprising a hex wrench with mounting clips attached to said recoil pad adapter plate.

18. A multi-axis adjustable buttstock which comprises;

a buttstock, having, a grip neck, and a butt, an interfaced set of two serrated grip retainers removeably positioned onto said flanged stock bolt for tilt adjustment of said buttstock, wherein a first grip retainer of said set of two serrated grip retainers have a plurality of recessed holes for attachment to a firearm segment, and a second grip retainer having a plurality of recessed holes for attachment to said buttstock grip neck, a plurality of selectable flat and tapered grip spacers engaging at least one of said set of two serrated grip retainers or said flanged stock bolt for adjusting trigger grip length, buttstock cast and buttstock drop by an addition and orientation of selected flat and/or tapered spacers between said grip neck, flanged stock bolt or one of the set of two serrated grip retainers.

19. A multi-axis adjustable buttstock which comprises;

a threaded rod threadably inserted into said buttstock for regulating buttstock length of pull, with locking means positioned on said threaded rod for securing said rod to said buttstock, wherein said locking means is a jam nut having a plurality of jam nut holes on a peripheral surface thereof for tightening with a hex wrench, a recoil pad adapter plate having a plurality of concentric holes for attachment to said threaded rod providing recoil pad slant according to the selected holes utilized, wherein said adapter plate having a plurality of threaded recoil pad holes in angled linear arrays, and a recoil pad attached to said adapter plate having a plurality of threaded recoil pad holes in angled linear arrays, with said recoil pad aligned with selected plurality of threaded recoil pad holes providing recoil pad height adjustment, and recoil pad angle adjustments produced by rotation of said threaded rod permitting a 360 degree alignment relative to said butt.

* * * * *